US005909918A

United States Patent [19]

Kowalewski et al.

[11] Patent Number: 5,909,918

[45] Date of Patent: Jun. 8, 1999

[54] VALET BLOCK OUT FOR DECK LID LATCH

[75] Inventors: Thomas Joseph Kowalewski, Rochester Hills; Matthew John Karl, Clarkston; Thomas Grzanka, Lexington; Robert Milne, Sterling Heights; Eric Michael Fischer, Davisburg; Vasanth Suratkal, Troy, all of Mich.

[73] Assignee: General Motors Corporation, Detroit, Mich.

[21] Appl. No.: 08/883,659

[22] Filed: Jun. 27, 1997

[51] Int. Cl.[6] ..... E05C 3/06

[52] U.S. Cl. ..... 292/199; 292/201; 292/142; 292/DIG. 23

[58] Field of Search ..... 292/199, 201, 292/DIG. 23, DIG. 26, DIG. 42, 142; 70/283

[56] References Cited

U.S. PATENT DOCUMENTS

| | | | |
|---|---|---|---|
| 3,113,447 | 12/1963 | Oishei | 70/262 |
| 3,698,690 | 10/1972 | Beaver | 254/186 |
| 3,850,410 | 11/1974 | Kemp | 254/186 |
| 3,939,729 | 2/1976 | Brockelsby | 74/575 |
| 4,312,197 | 1/1982 | Carrion et al. | 70/135 |
| 4,518,182 | 5/1985 | Cousin et al. | 292/201 |
| 4,702,094 | 10/1987 | Peterson | 70/241 |
| 4,752,092 | 6/1988 | Faust | 292/336.3 |
| 4,796,932 | 1/1989 | Tame | 292/341.16 |
| 4,962,955 | 10/1990 | Ferrara et al. | 292/216 |
| 5,007,261 | 4/1991 | Quantz | 292/201 |
| 5,020,838 | 6/1991 | Fukumoto | 292/201 |
| 5,054,826 | 10/1991 | Dow et al. | 292/125 |
| 5,409,277 | 4/1995 | Rogers, Jr. et al. | 292/201 |
| 5,474,338 | 12/1995 | Buscher | 292/201 |
| 5,511,838 | 4/1996 | Baughman et al. | 892/336.3 |
| 5,564,308 | 10/1996 | Hoshikawa et al. | 292/201 |
| 5,639,130 | 6/1997 | Rogers, Jr. et al. | 292/201 |
| 5,649,726 | 7/1997 | Rogers, Jr. et al. . | |

*Primary Examiner*—Steven Meyers
*Assistant Examiner*—Teri Pham
*Attorney, Agent, or Firm*—Charles E. Leahy; Kathryn A. Marra

[57] ABSTRACT

A deck lid may be released via rotation of a latch release shaft. A pinion gear is operably connected with the release shaft for rotating the release shaft. An electric motor has a gear meshing with the pinion gear and is energizable to rotate the pinion gear. An electrical switch is located inside the vehicle for energizing the electric motor. According to the invention, a blocking member is movably mounted on the latch and movable between a normal disengaged position, permitting rotation of the pinion gear by the motor, and a blocking position in which the blocking member engages the pinion gear to block rotation thereof by the electric motor. In a preferred embodiment, the blocking member is slidably mounted on the latch and the pinion gear has a toothed periphery with a cutout into which the blocking member is slid to block rotation of the pinion gear, thereby causing the motor to stall.

2 Claims, 3 Drawing Sheets

VALET BLOCK OUT FOR DECK LID LATCH

TECHNICAL FIELD

This invention relates to a remote releasable deck lid latch and, more particularly, provides a blocking member selectively engageable to stall an electric motor which would otherwise release the latch.

BACKGROUND OF THE INVENTION

Motor vehicles typically have a latch for latching a deck lid in a position closing a luggage compartment. The latch is released by a key cylinder to open the lid and permit access to the luggage compartment.

It is also known to provide remote release of the latch by mounting an electric motor on the latch and energizing the motor via an electrical switch provided inside the occupant compartment so that the driver may release the latch. The disadvantage of this remote release for the deck lid is that a person who has entry into the occupant compartment, such as a valet parking attendant, will also have access to the luggage compartment by actuating the switch. Accordingly, the prior art has proposed a secondary electrical switch located within the luggage compartment which is selectively switchable to prevent energization of the motor by the inside switch.

The present invention provides a new and improved disabling device for preventing the release of the deck lid latch via the remote energized motor.

SUMMARY OF THE INVENTION

A deck lid latch may be released via rotation of a latch release shaft. A pinion gear is operably connected with the release shaft for rotating the release shaft. An electric motor has a gear meshing with the pinion gear and is energizable to rotate the pinion gear. An electrical switch is located inside the vehicle for energizing the electric motor. According to the invention, a blocking member is movably mounted on the latch and movable between a normal disengaged position, permitting rotation of the pinion gear by the motor, and a blocking position in which the blocking member engages the pinion gear to block rotation thereof by the electric motor. In a preferred embodiment, the blocking member is slidably mounted on the latch and the pinion gear has a toothed periphery with a cutout into which the blocking member is slid to block rotation of the pinion gear thereby causing the motor to stall.

BRIEF DESCRIPTION OF THE DRAWINGS

These and other features, objects and advantages of the invention will become apparent upon consideration of the Description of the Preferred Embodiment and the appended drawings in which.

DESCRIPTION OF THE PREFERRED EMBODIMENT

Figure 1:
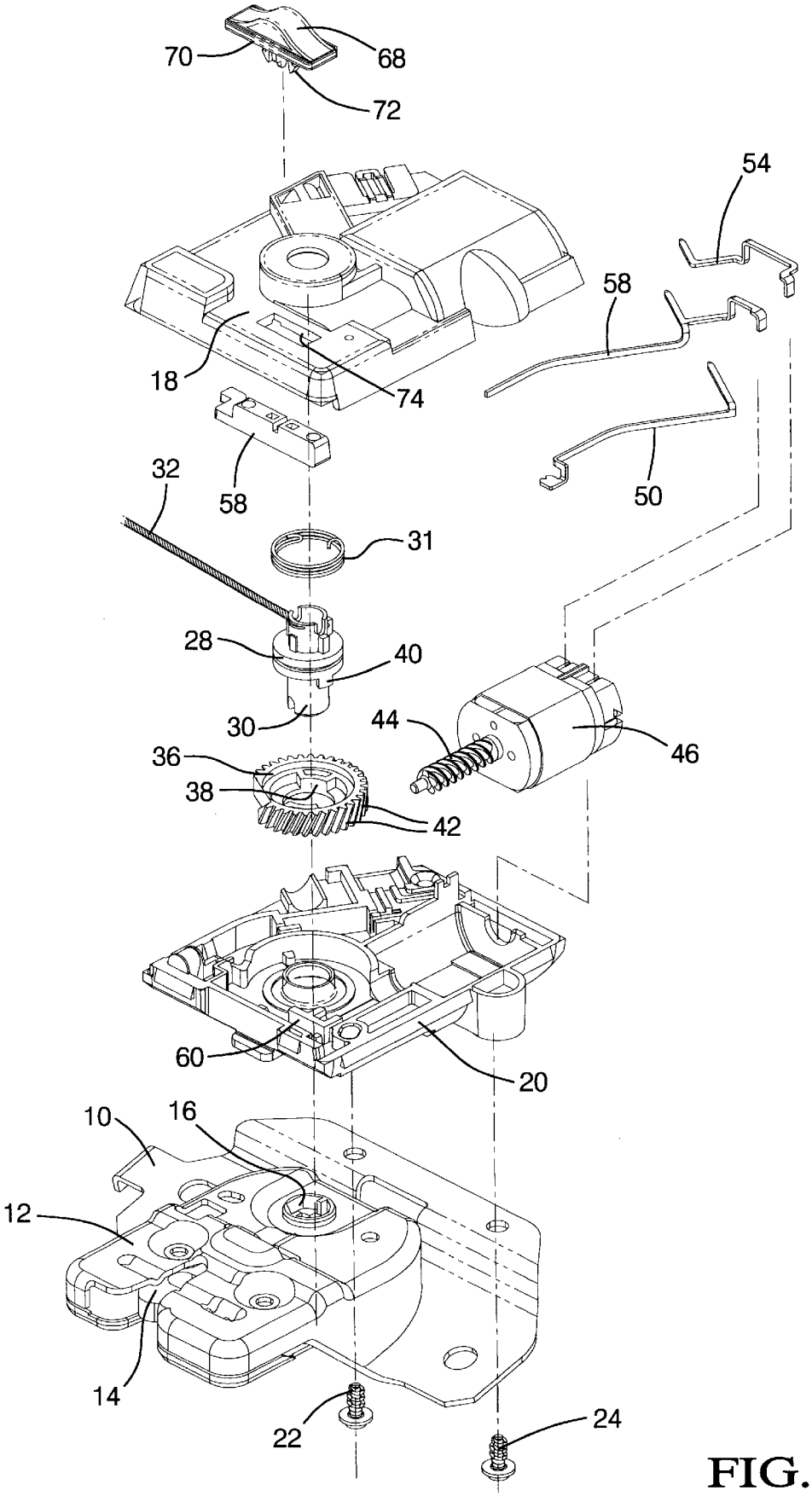
FIG. 1 an exploded perspective view of the deck lid latch according to this invention.

Referring to FIG. 1, there is shown a conventional vehicle deck lid latch 10 having housing 12 which mounts a fork bolt 14 for engaging a striker. A detent lever, not shown, is located within the latch housing 12 for latching the fork bolt 14 in its latched position. A release shaft 16 is journaled within the housing 12 and is rotatable to pivot the detent lever and thereby unlatch the fork bolt 14 to permit opening of the deck lid.

A plastic housing including upper half 18 and lower half 20 is retained upon the latch housing 12 by screws 22 and 24. A drive shaft 28 has a lower end 30 which is keyed with the release shaft 16 so that rotation of the drive shaft 28 will rotate the release shaft 16 to release the latch. A spring 31 seats on housing 18 and urges drive shaft 28 to a normal rest position. A cable 32 wraps around the drive shaft 28 and has its other end suitably connected with a key operated cylinder, not shown. The operation of the key cylinder by a key will rotate the drive shaft 28 to release the latch.

The latch 10 may also be released by rotation of a pinion gear 36. The pinion gear 36 has a drive lug 38 which will engage with a complimentary lug 40 provided on the drive shaft 28 upon rotation of the pinion gear, sufficient to carry the drive lug into engagement with the lug 40 of the drive shaft 28. The pinion gear 36 has teeth 42 on the periphery thereof which mesh with a worm gear 44 driven by electric motor 46. The electric motor 46 is energized by an electrical circuit which includes connector strips 50, 52 and 54 and an electrical switch, not shown, mounted inside the occupant compartment, conveniently accessible to the driver.

A blocking member 58 is slidably captured within a cavity 60 of the lower housing 20 and has a blocking tooth 64. A knob 68 has snap tabs 70 and 72 which reach through a cutout 74 of upper housing 18 to mate with recesses provided in the blocking member 58.

Figure 2:
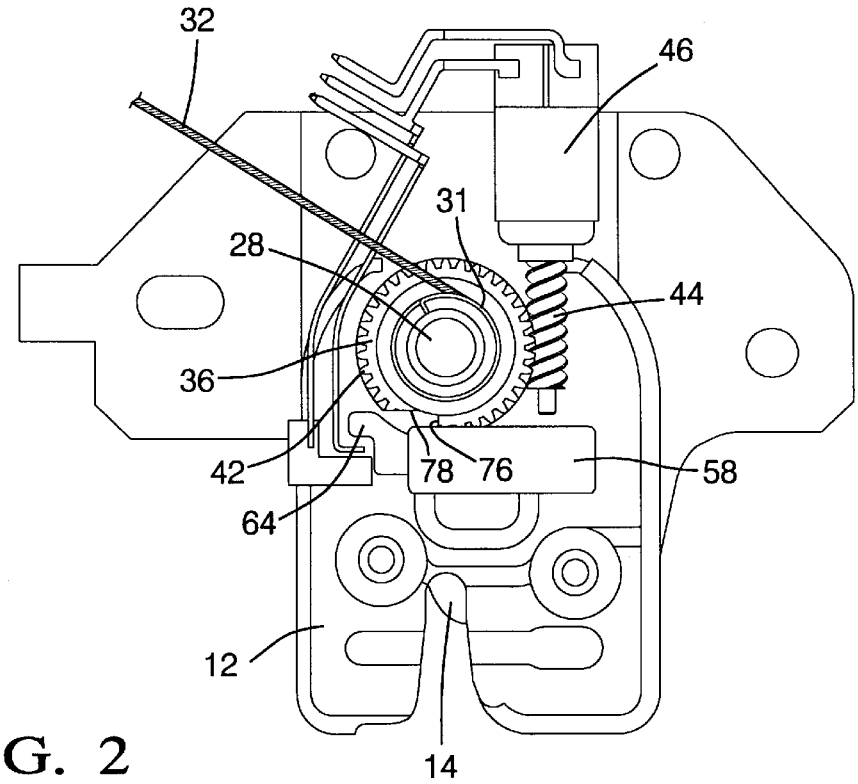
FIG. 2 is an elevation view of the latch having parts broken away and in section and showing the blocking member in the disengaged position permitting rotation of the pinion gear by the electric motor.

Referring to FIG. 2, the spring 31 has positioned the drive shaft 28 and pinion gear 36 in their normal rest positions. Energization of the motor 46 by the remote switch located in the passenger compartment will rotate the pinion gear 36 counterclockwise to, in turn, rotate the drive shaft 28 and release shaft 16 to release the fork bolt 14 and permit opening of the deck lid.

Figure 3:
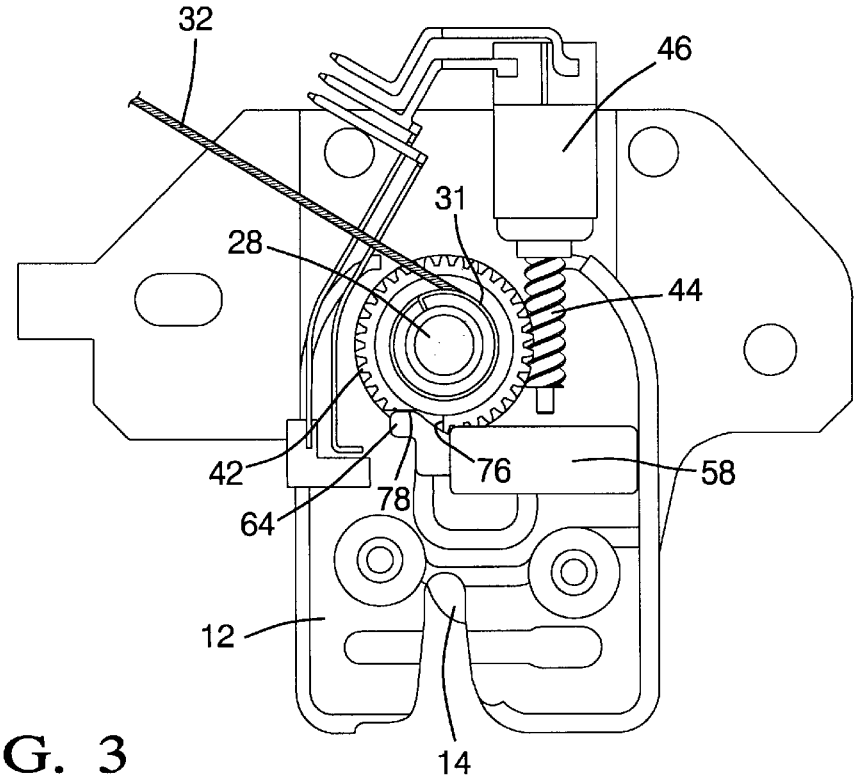
FIG. 3 is view similar to FIG. 2 showing the blocking member slid to engaging position blocking rotation of the pinion gear by the electric motor.

Referring now to FIG. 3, it is seen that the blocking member 58 has been slid rightwardly so that the blocking tooth 64 becomes engaged within a cutout 76 in the periphery of the gear 36 and abuts against a shoulder 78. Accordingly, any attempted counterclockwise rotation of the drive gear 36 upon energization of the electric motor 46 will be blocked by engagement of the shoulder 78 with the blocking tooth 64, thereby causing the motor 46 to be stalled.

Accordingly, it will be understood that moving the blocking member 58 rightwardly to the blocking position of FIG. 3 will be effective to prevent a valet parking attendant or other unauthorized vehicle occupant from unlatching the deck lid. However, the installation of a properly bitted key within the key cylinder will tension the cable 32 and thereby rotate the drive shaft 28 and release shaft 16 to accomplish unlatching of the deck lid latch.

Figure 4:
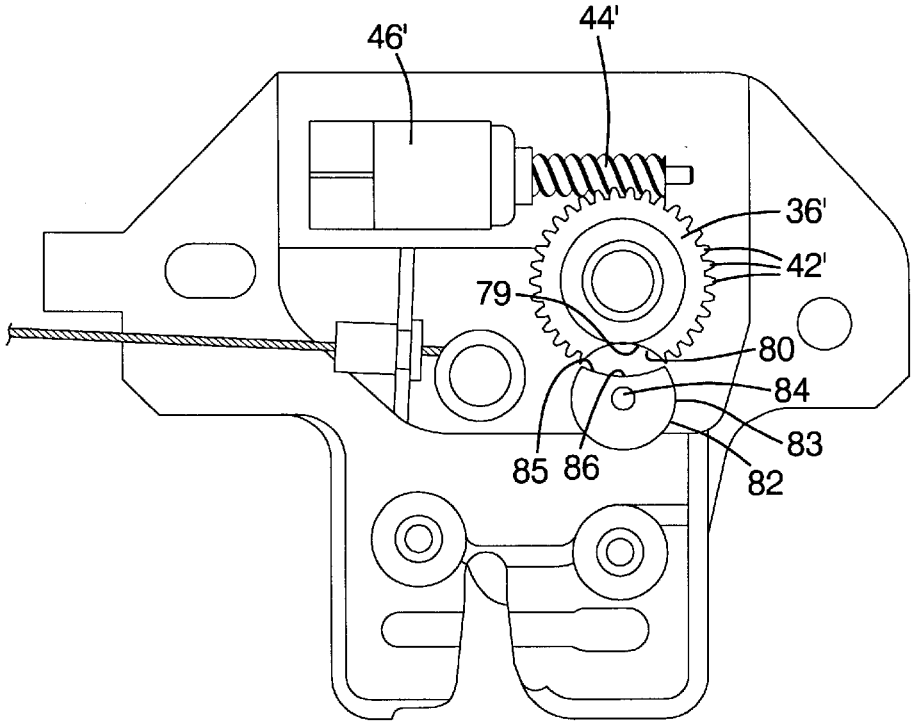
FIG. 4 is an elevation view of a second embodiment of the invention showing the blocking member disengaged from the pinion gear to permit rotation of the pinion gear.

Referring to FIG. 4, a second embodiment of the invention is shown in which the pinion gear 36' has peripheral teeth 42'. A peripheral segment 79 of the periphery of gear 36' is cutout to provide a concave shoulder surface 80. A rotary blocking member 82 is mounted on the shaft 84 and has a peripheral surface 83 from which a peripheral segment 85 is cutout to define a concave clearance surface 86.

FIG. 4 shows the normal, at rest position of the pinion gear 36' and the rotary blocking member or wheel 82 is shown in its normal, unblocking position in which the concave clearance surface 86 thereof registers with the pinion gear 36'. Accordingly, energization of the motor 46' will rotate the pinion gear 36' to unlatch the deck lid latch.

Figure 5:
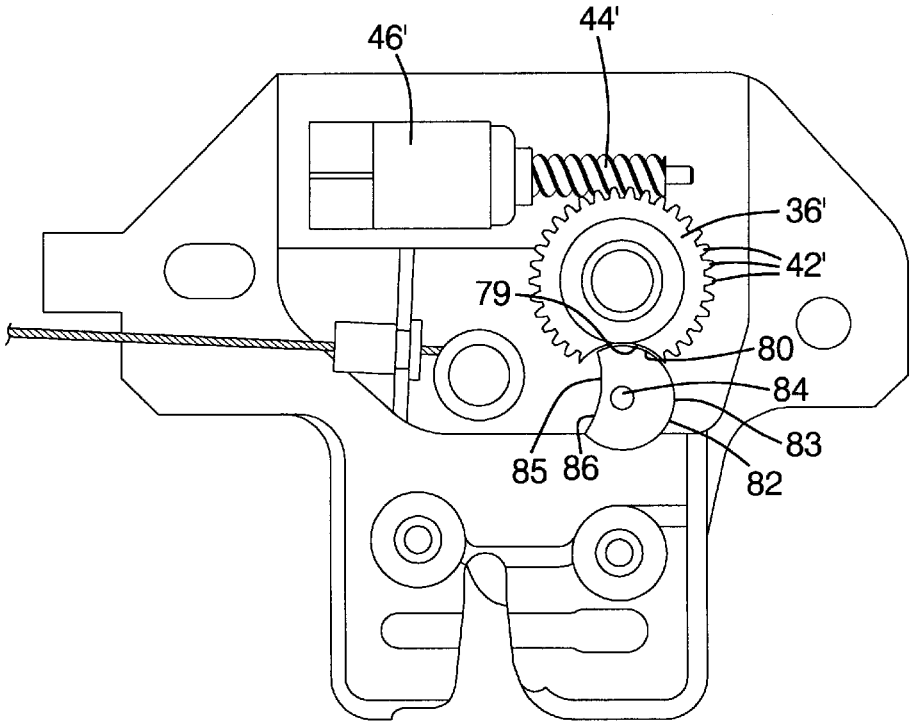
FIG. 5 is a view similar to FIG. 4 but showing the blocking member rotated to an engaging position blocking rotation of the pinion gear by the motion.

Referring now to FIG. 5, it is seen that the pinion gear 36' is shown in its normal rest position, however, the rotary blocking member 82 has been rotated so that its peripheral surface 83 has become engaged within the cutout peripheral segment 79 of the pinion gear 36. Accordingly, energization of the motor will cause the concave shoulder surface 80 of the pinion gear 36' to engage with the peripheral surface 83 of the rotary blocking member 82 to block rotation of the pinion gear 36' and stall the motor.

Thus, it is seen that the invention provides a new and improved valet block out for a motor-released deck lid latch and more particularly provides a blocking member which is movable into obstruction with a motor driven pinion gear to stall the motor and thereby prevent unlatching of the deck lid of the luggage compartment.

We claim:

1. In a vehicle having a luggage compartment lid openable upon release of a latch via rotation of a latch release shaft, the improvement comprising:

a pinion gear connected with the release shaft for rotating the release shaft to release the latch, said pinion gear having a periphery with gear teeth disposed on only a portion of the periphery and a cutout on the non-toothed portion of the periphery for defining an abutment against which a blocking member engages to block rotation of the pinion gear;

an electric motor having an associated gear meshing with the pinion gear and energizable to rotate the pinion gear and release shaft;

the blocking member slidably mounted on the latch and movable between a normal disengaged position permitting rotation of the pinion gear and a blocking position in which the blocking member engages the abutment of the pinion gear to block rotation thereof by the electric motor.

2. In a vehicle having a luggage compartment lid openable upon release of a latch via rotation of a latch release shaft, the improvement comprising:

a pinion gear connected with the release shaft for rotating the release shaft to release the latch, said pinion gear having a peripheral segment thereof cutout to provide a concave shoulder surface;

an electric motor having an associated gear meshing with the pinion gear and energizable to rotate the pinion gear and release shaft;

and a blocking member rotatably mounted on the latch and having a peripheral surface with a cutout defining a concave clearance surface so that when the concave surface of the blocking member registers with the pinion gear, the pinion gear is permitted to rotate and when the blocking member is rotated the peripheral surface of the blocking member is engaged by the concave shoulder surface of the pinion gear to block rotation thereof.

* * * * *